United States Patent [19]

Smith

[11] Patent Number: 4,854,497

[45] Date of Patent: Aug. 8, 1989

[54] TRASH COLLECTION UNIT

[76] Inventor: Billy J. Smith, 2412 Magnolia Ave., Knoxville, Tenn. 37919

[21] Appl. No.: 271,095

[22] Filed: Nov. 14, 1988

[51] Int. Cl.[4] ..... B65D 91/00

[52] U.S. Cl. ..... 232/43.4; 248/907

[58] Field of Search ..... 211/81, 84, 88; 248/DIG 7, 146; 232/43.4, 43.1, 20, 27, 29

[56] References Cited

U.S. PATENT DOCUMENTS

| | | | |
|---|---|---|---|
| 458,273 | 8/1891 | Scott . | |
| 815,770 | 3/1906 | Weston . | |
| 3,106,335 | 10/1963 | Allan | 232/17 |
| 3,110,438 | 11/1963 | Leckner | 232/43.4 |
| 3,836,187 | 9/1974 | Buettner | 232/43.4 X |
| 4,447,005 | 5/1984 | Kelly et al. | 232/43.4 X |
| 4,473,159 | 9/1984 | Pressler | 248/DIG. 7 X |
| 4,753,386 | 7/1988 | Phillion, Jr. | 232/43.1 |
| 4,757,942 | 7/1988 | Young | 232/43.4 X |

*Primary Examiner*—Robert W. Gibson, Jr.

[57] ABSTRACT

A trash collection unit for mounting within a fence or the like which may surround a residence includes a receptacle having an elongated housing having two opposite ends and front and rear doors connected to the housing for closing the ends thereof. The rear door provides access to the interior of the receptacle for placement of trash therein, and the front door provides access to the receptacle interior for removal of trash therefrom. The unit further includes one tension member permitting the front and rear doors to be simultaneously locked in their closed positions at the rear of the unit, and another tension member permits the rear door, by itself, to be locked in its closed position. The unit protects trash placed therein from rifling and/or pilferage, and when mounted in a fence, the unit obviates any need for an individual to walk outside of the fence for rendering his trash accessible to a garbage collector.

16 Claims, 2 Drawing Sheets

TRASH COLLECTION UNIT

BACKGROUND OF THE INVENTION

This invention relates to trash collection units into which trash is placed for subsequent pick-up by a trash collector.

In order for trash to be picked up for disposal at residences which are bounded by fences, walls, or the like, the trash must commonly be placed outside of the fence or wall so as to be accessible to a trash collector. Of course, placement of the trash outside the fence for collection commonly necessitates that an individual walk outside the fence with the trash. In areas in which crime rates are relatively high, bodily safety of the individual walking outside the fence can be a major concern, and this may be particularly true in urban environments in which trash is commonly picked up for disposal in alleyways.

Moreover, it is not uncommon that trash awaiting collection is rifled or pilfered by vandals or rodents so that trash which may have been neatly confined to a bag or garbage can becomes scattered over a broad area. Of course, scattered trash is generally unsightly, and the undesirable task of picking up and regathering the scattered trash usually falls upon the individual responsible for the trash.

It is an object of the present invention to provide a new and improved trash collection unit within which trash can be placed for subsequent pick-up by a trash collector.

Another object of the present invention is to provide such a unit which is well-suited for mounting in a fence or wall enclosing a residence so that any need for an individual to walk outside of the fence or wall with his trash in order to render the trash accessible to a collector is obviated.

Still another object of the present invention is to provide such a unit for protecting trash placed therein from rifling or pilferage.

A further object of the present invention is to provide such a unit having an access door at an end thereof which can be locked and unlocked at the opposite end of the unit to accommodate locking and unlocking of the access door at the opposite end when the unit is mounted within a residence-enclosing fence.

A further object of the present invention is to provide such a unit which suitably protects trash placed therein from rain or other forms of precipitation.

A still further object of the present invention is to provide such a unit which is relatively attractive and compact in appearance so that the attractiveness of the environment within which the unit is located is enhanced.

SUMMARY OF THE INVENTION

This invention resides in a trash collection unit within which trash is placed for subsequent collection.

The trash collection unit includes a receptacle including an elongated housing having opposite front and rear ends and front and rear doors connected to the housing at the front and rear ends. The rear door provides access to the housing interior accommodating placement of trash into the receptacle, and the front door provides access to the housing interior accommodating removal of the trash from the receptacle. Each of the front and rear doors is movable between an opened position and a closed position, and the unit further includes means for releasably locking both the front and rear doors in their closed positions at the rear of the housing.

When the unit is operatively mounted within a fence or wall enclosing a residence so that the front of the housing is accessible from outside the residence enclosure and the rear of the housing is accessible from only inside the enclosure, trash can be placed within the unit through the rear door thereof for subsequent collection through the front door with no need for an individual to walk outside of the residence enclosure. Therefore, the unit enhances the safety of an individual who may otherwise be concerned with his exposure to harm when carrying out his trash for subsequent collection. Moreover, the locking means permits an individual to remain within the safety of this residence enclosure when locking the front door of the unit for protection of trash placed within the unit or unlocking the front door for permitting access to the trash by a trash collector.

DETAILED DESCRIPTION OF THE-ILLUSTRATED EMBODIMENTS

Figure 1:
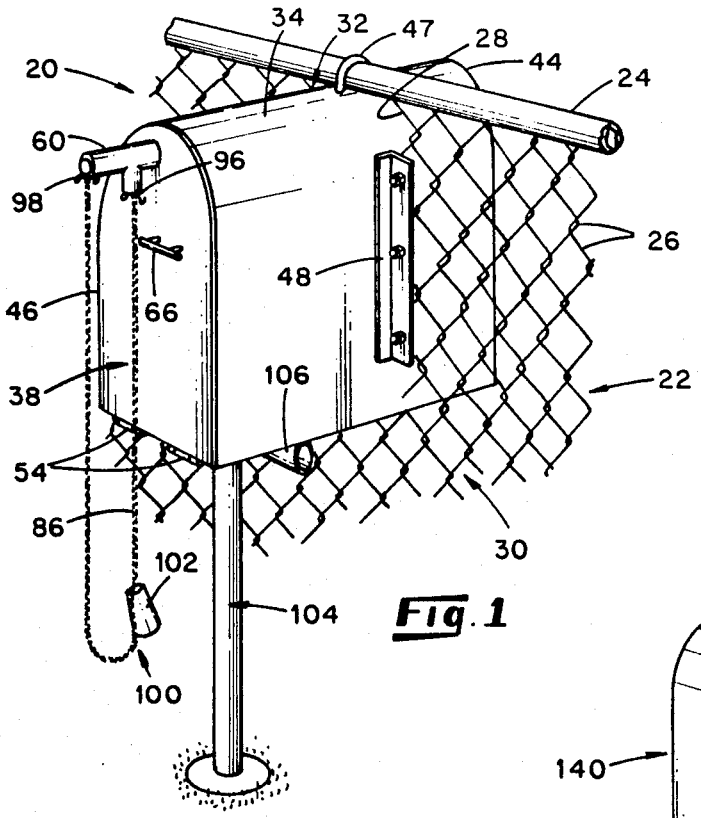
FIG. 1 is a perspective view of a trash collection unit shown operatively mounted within a fence.
Figure 2:
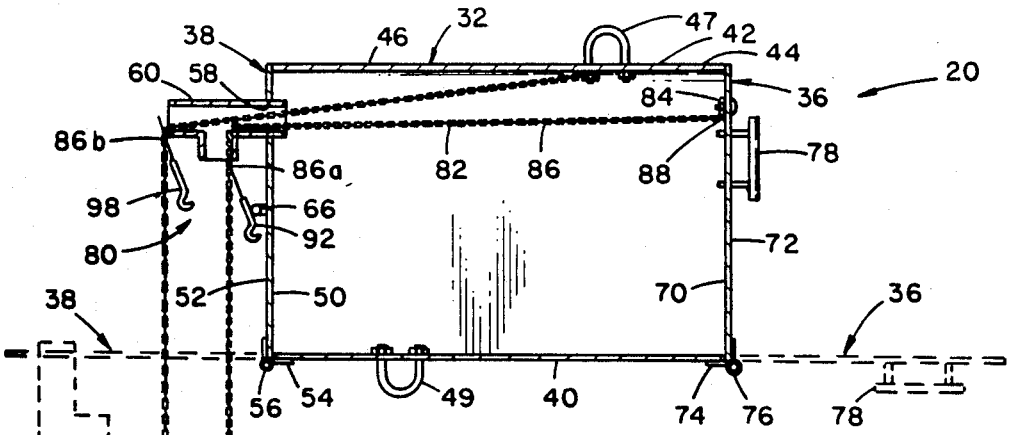
FIG. 2 is a longitudinal cross-sectional view of the unit of FIG. 1 shown before the doors thereof are locked in their closed position.

Turning now to the drawings in greater detail and considering first FIGS. 1 and 2, there is shown an embodiment, generally indicated 20, of a trash collection unit shown operatively mounted in a typical environment of intended use. More specifically, the environment includes a chain-link fence 22 bordering the yard of a residence so as to separate the region inside the yard from the region outside the yard. The fence 22 includes a top rail 24 and plurality of wires 26 appropriately shaped and interwoven to form a wire mesh 30 suspended from the top rail 24. A preformed hole 28 is defined within the mesh of the fence 22, and the trash collection unit 20 is mounted within the hole 28 in a manner explained herein.

With reference still to FIGS. 1 and 2, the trash collection unit 20 includes means defining a receptacle 32 including an elongated hollow housing 34 having front and rear ends 44 and 46, respectively, and front and rear doors 36 and 38, respectively, hingedly connected at the front and rear ends of the housing 34. As is apparent herein, the rear door 38 provides access to the interior to the housing 34 for placement of trash within the receptacle 32, and the front door 36 permits access to the housing interior of the trash placed therein by a trash collector.

As best shown in FIG. 2, the housing 34 includes a generally planar bottom 40 and a cover 42 attached to the bottom 40 so as to provide two opposite planar sides and an arcuate top for the housing 34. For purposes of attachment of the unit 20 to the fence 22, a pair of vertically-oriented mounting brackets 48 (only one shown in FIG. 1) are secured to opposite sides of the housing 34, and a U-bolt 47 extends through the cover 42 of the housing 34 in the top thereof. When mounting the unit 20 to the fence 22, the brackets 48 are bolted or otherwise secured to the wire mesh 30 of the fence 22, and the U-bolt 47 is secured about the top rail 24. Additional U-bolts 49 (only one shown in FIG. 2) extend through the bottom 40 of the housing 34 for a reason apparent herein. It is preferred that the housing 34 be constructed of a sheet metal or relatively rigid plastic, but it will be understood that the housing can be constructed of any of several suitable materials.

The rear door 38 of the unit 20 is platen in form and defines opposite inside and outside surfaces 50 and 52 respectively. Hinges 54 connect the bottom edge of the door 38 to the rear edge of the housing bottom 40 so that the rear door 38 can be pivotally moved from a closed, generally vertical position as shown in solid lines in FIG. 2, to a closed, generally horizontal, position as shown in phantom in FIG. 2. If desired, an optional spring 56 can be integrated with the hinges 54 for biasing the door 38 from its opened to its closed position. To facilitate the opening and closing of the rear door 36, a handle 66 is attached to the outside surface 52.

Figure 3:
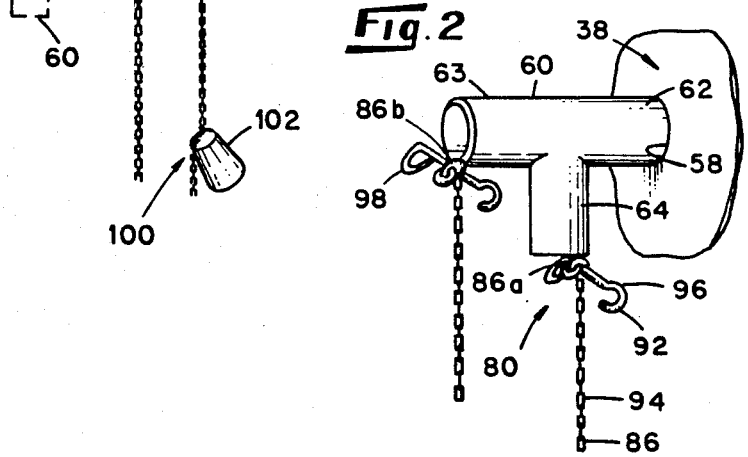
FIG. 3 is a perspective view of a fragment of the FIG. 1 unit.

It will be understood that the rear door 38 is sized so that when in its closed position, the opening defined in the rear end 46 of the housing 34 is completely covered. Moreover and for a purpose apparent herein, a through-aperture 58 extends between the inside and outside surfaces 50, 52 of the rear door 38, and a hollow T-shaped member 60 is appropriately attached to the rear door 38 so that the arms of the member 60 are aligned with the aperture 58. In the depicted embodiment 20 and as best shown in FIG. 3, the T-shaped member 60 is provided by a pipe Tee-fitting having arm members 62 and 63 and a hollow base leg 64 having hollow interiors which are in communication with one another.

With reference again to FIG. 2, the front door 36 is platen-like in form and define opposite inside and outside surfaces 70 and 72, respectively. Hinges 74 connect the bottom edge of the door 36 to the forward edge of the housing bottom 40 so that the front door 36 can be pivotally moved from a closed, generally vertical position, as shown in solid lines in FIG. 2, to an opened, generally horizontal position as shown in phantom in FIG. 2. To facilitate the opening of the door 36, a handle 78 is attached to the outside surface 72. In addition, a spring 76 is integrated with the hinges 74 for biasing the door 36 from its opened position toward its closed position. Each of the front or rear doors 36 or 38 can be constructed of plastic, steel or wood but it will be understood that other materials are suitable.

The front door 36 is sized so that when in its closed condition, the opening defined in the front end 46 of the housing 44 is completely covered. Therefore, when both the front and rear doors 36, 38 are closed, the receptacle 32 is totally enclosed so as to provide a protective enclosure for trash placed therein from rain or other forms of precipitation and from rodents which may otherwise pilfer the trash. It has been found that a receptacle 32 having a length as measured between the doors 36, 38 of about 19.0 inches (48.3 cm), a width of about 11.0 inches (27.9 cm), and a height of about 20 inches (50.8 cm) is well-suited for retaining compacted trash removed from a trash compactor. Furthermore, the relatively compact nature and shape of the receptacle 32 provide the unit 20 with a relatively attractive appearance so that the environment within which the unit 20 is ultimately used is believed to be enhanced.

With reference still to FIG. 2, the unit 20 includes means, generally indicated 80, permitting both of the front and rear doors 36, 38 of the unit 20 to be releasably locked in their closed position at the rear of the unit 20. In this connection, the unit 20 includes a tension member 82 connected to the front door 36 and extending the length of the housing 34 through the rear thereof and a fastener 92 cooperating with the tension member 82 adjacent the rear door 38. In the depicted embodiment 20, the tension member 82 is in the form of a chain 86 having one end, indicated 88, fixedly secured to the front door 36 by means of a screw 84 and which extends out through the rear door 38 through the T-shaped member 60 so that a section, indicated 94, of the chain 86 hangs out of the base leg 64 of the member 60. In the unit 20, the fastener 92 is in the form of a piece 96 of strong wire insertable through a link of the chain 86 and bendable to a condition so that the wire piece 96 is prevented from passing through the T-shaped member 60. In order to lock the doors 36, 38, the chain section 94 is pulled through the member 60 so that the chain 86 becomes taut and the wire piece 96 is fastened through the chain link, indicated **86*a*, so that the link 86*a* is prevented from passing through the member 60 toward the front of the housing 34. The front and rear doors 36, 38 are thus bound to one another, and if either the front or rear doors 36 or 38 is subsequently urged from its closed position toward its opened position, the wire piece 96 and mouth of the base leg 64 abut one another so as to prevent the movement of the door out of its closed position. To unlock the doors 36, 38, the wire piece 96 is removed from the chain link 86*a***.

It follows from the foregoing that the locking means 80 of the unit 20 accommodates a simultaneous locking of the front end rear doors 36, 38. In other words, by fastening the wire piece 96 about the chain link **86*a* in order to lock one of the front or rear doors 36 or 38, the other door 38 or 36 is also locked. On occasion, however, it may be desirable to lock only the rear door 38 and leave the front door 38 unlocked for access to the housing interior by the trash collector. To this end, the chain section 94 suspended through the base leg 64 of the member 60 is routed back through the member 60 through the arm members 62, 63 and fastened with the U-bolt 47 to the housing cover 42, and a second fastener, in the form of a wire piece 98, is fastenable to the chain 86 adjacent the arm member 62. In order therefore to lock only the rear door 38 with the chain 86 and wire piece 98, the chain 86 is pulled taut through the arm members 62, 64 from the U-bolt 47, and the wire piece 98 is inserted and fastened about a link, indicated 86*b*, of the chain 86 adjacent the arm member 63 so that the chain 86 is prevented from being drawn through the T-shaped member 60 toward the U-bolt 47. When the rear door 38 is thereafter attempted to be moved from its opened position toward its closed position, the mouth of the arm member 63 and the wire piece 98 abut one another to prevent movement of the rear door 38** out of its closed position.

It follows that with the wire piece 96 unfastened from the chain link **86*a*, the front door 36 can be pivotally moved between its closed and opened positions because the chain 86 is free to pass back and forth through the base leg 64 of the member 60. Similarly, with both wire pieces 96 and 98 removed from the chain 86, the rear door 38 can be pivotally moved between its open and closed positions because the chain 86 is free to pass back and forth through the base leg 64 and the arm member 63 of the member 60**.

The unit 20 further includes means, generally indicated 100, associated with the rear of the housing 38 for biasing the front door 36 to its closed position. Such biasing means 100 are in addition to or may be substituted for the spring 76 integrated with the front door hinges 74 and are provided by a weight 102 affixed to the chain section 94 as illustrated in FIGS. 1 and 2. The weight 102 is sufficiently heavy so that when the front door 36 is moved to its opened condition and subsequently released, the weight 102 returns the front door 36 to its closed position. Because trash collector may, for some reason, not return the front door 36 to its closed position upon removal of the trash from the unit 20, the weight 102 provides means for automatically closing the front door 36 and 102 and is believed to be advantageous in this respect.

For assisting in the support of the unit 20 when mounted within the fence 22 and with reference again to FIG. 1, a support post 104 has been embedded within the ground adjacent the fence 22. The support post 104 has a cross-member 106 at its upper end upon which the unit 20 rests.

To mount the unit 20 within the fence, the receptacle 32 is inserted endwise through the preformed hole 28 defined in the wire mesh 30 of the fence until the brackets 48 located on opposite sides of the housing 34 contact the mesh 30. With the brackets 48 in contact with the fence as aforedescribed, the U-bolts 49 (FIG. 2) are in position for attachment about the cross-member 106 of the support post 104. Accordingly, each of the brackets 48 and U-bolts 47 and 49 are appropriately located in relation to one another to accommodate the aforedescribed positioning in relationship to the fence 22.

Figure 4:
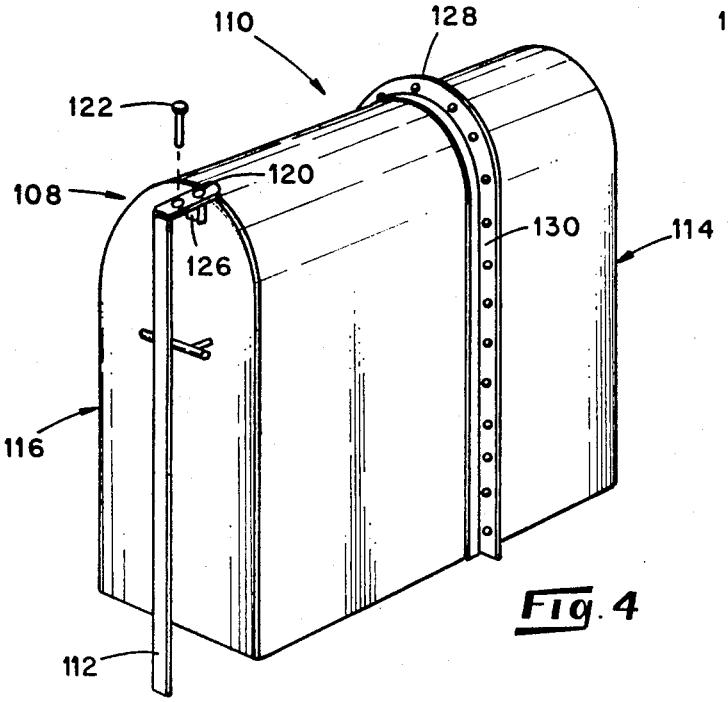
FIG. 4 is a perspective view of an alternative embodiment of a trash collection unit, shown exploded.
Figure 5:
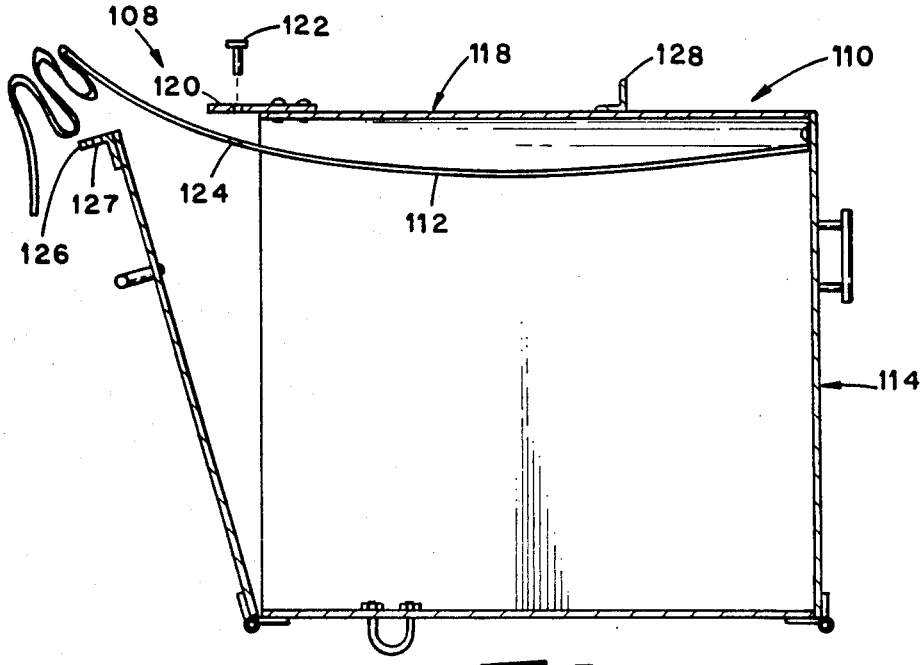
FIG. 5 is a longitudinal cross-sectional view of the unit of FIG. 4 shown with its rear door in a partially opened condition and before the doors of the unit are locked in their closed position.

It will be understood that numerous modifications and substitutions can be had to the aforedescribed embodiment 20 without departing from the spirit of the invention. For example, although the means for locking both the front and rear doors in their closed position has been shown and described above as including a chain 86 extending through the rear door, such means for locking may take alternative forms. For example, there is illustrated in FIGS. 4 and 5 an alternative embodiment, generally indicated 110, of a trash collection unit including means for locking the front and rear doors in their closed position in the form of a pin-and-strap arrangement 108. Such an arrangement 108 includes a leather strap 112 fixed at one end to the inside surface of the unit front door 114 and extending through the rear of the unit between the edge of the unit rear door 116 and the edge of the unit housing 118 at the rear end thereof. A metal tab 120 is affixed to the housing 118 so as to project from the rear thereof and defines an opening therein for receiving a pin 122. The strap 112 defines an opening 125 which is aligned with the opening of the tab 120 when pulled taut through the housing 118, and the rear door 116 includes a tab 126 having an opening 127 which is aligned with the opening of the tab 120 when the door 116 is closed. Therefore and in order to lock the front and rear doors 114, 116, the strap 112 is pulled taut through the housing 118 and positioned between the tabs 120, 126 so that the openings defined therein are aligned. The pin 122 is then inserted through the aligned openings of the tabs 120, 126 and strap 112.

Furthermore and although the means by which the unit 20 of FIGS. 1–4 is mounted upon the fence 22 has been shown and described as including a pair of mounting brackets 84 and a U-bolt 47, such mounting means may take alternative forms. For example, there is shown in the unit 110 of FIGS. 5 and 6 a collar-like bracket 128 extending around the sides and top of the housing 118. The bracket 128 defines an outwardly-extending flange 130 defining a series of through openings for attachment of the bracket 128 to the mesh of a fence. The collar-like bracket 128 of the unit 110 of FIGS. 5 and 6 may be preferred over the bracket 84 of the unit 20 when mounting in a preformed opening of a fence surrounded entirely by wire mesh.

Figure 6:
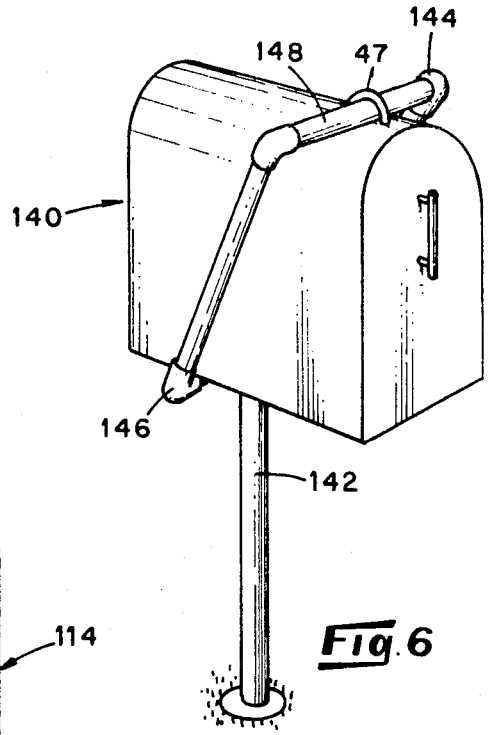
FIG. 6 is a perspective view of another embodiment of a trash collection unit.

Still further, although the aforedescribed embodiments 20, 110 of FIGS. 1–5 have been shown and described as including means with which the embodiments can be mounted within a fence, an embodiment in accordance with the broader aspects of this invention does not require such fence-mounting means. For example, there is illustrated in FIG. 6 another embodiment, generally indicated 140, of a trash collection unit supportable upon a support post 142 and unaffiliated with a fence or wall. The support post 142 and its associated bracework 144 are constructed of a polyvinylchloride (PVC) pipe having a first horizontally-arranged section 146 upon which the bottom of the unit 140 rests and a second horizontally-arranged section 148 to which the top of the unit 140 is attached by means of a U-bolt 47. It is believed that the unit 140 and support post 142 are well-suited for use in residential areas, such as suburban neighborhoods, where residence-enclosing fences are not common. In such an area, the unit 140 and post 142 should probably be placed relatively close to the street so as to be most accessible to a trash collector.

Accordingly, the aforedescribed embodiments are intended for the purpose of illustration and not as limitation.

What is claimed is:

1. A trash collection unit comprising:

a receptacle including an elongated housing having opposite open front and rear ends, a rear door connected to said housing at the rear end thereof providing access to the housing interior for placement of trash into the receptacle, and a front door connected to the housing at the front end thereof providing access to the interior of the housing for removal of trash from the receptacle, each of the front and rear doors being movable between an opened position and a closed position; and means for releasably locking both the front and rear doors in their closed positions at the rear of the housing.

2. The unit as defined in claim 1 wherein the means for releasably locking is adapted to effect a simultaneous locking of the front and rear doors.

3. The unit as defined in claim 1 wherein said means for locking includes an elongate tension member attached to the front door and releasably attachable to the rear door so that when the tension member is attached to the rear door, each door opposes movement of the other door out of its closed position.

4. The unit as defined in claim 3 wherein said means for locking includes a fastener cooperable with the tension member for releasably securing the tension member to the rear door.

5. The unit of claim 1 in combination with a fence or the like enclosing a residence and the unit is mounted within the fence or the like so that the rear of the housing is accessible from only inside the fence and the front of the housing is accessible from outside the fence so that the front door can be selectively locked or unlocked from only inside the fence.

6. A trash collection unit for mounting in a fence or the like enclosing a residence comprising:

receptacle means including an elongated hollow housing having open front and rear ends, a rear access door connected to the housing at the rear thereof and movable between an opened position and a closed position, and a front access door connected to the housing at the front thereof and movable between an opened position and a closed position so that trash can be placed into the receptacle through the rear door thereof and removed through the front door thereof; and means for releasably locking both the front and rear doors in their closed position at the rear of the housing.

7. The unit as defined in claim 6 wherein the means for releasably locking is adapted to effect a simultaneous locking and unlocking of the front and rear doors.

8. The unit as defined in claim 6 wherein the means for releasably locking includes a tension member affixed at one end to the front door, extending through the housing to the rear door and connectable to the rear door so as to bind the front and rear doors in their closed positions.

9. The unit as defined in claim 8 wherein the tension member includes a section which extends through the rear of the housing, and the rear door is connectable to said section of the tension member so that any urging of the front or rear door out of its closed position is prevented by the closed condition of the other of the front or rear door.

10. The unit as defined in claim 9 wherein said section of the tension member defines an opening therein adjacent the rear door and positioned on the outside thereof and the means for releasably locking further includes a fastener insertable through said section opening and cooperable with the rear door for capturing the rear door between the fastener and the front door.

11. The unit as defined in claim 8 further comprising a weight attached to said tension member outside of the housing so as to be suspended from the rear thereof for biasing the front door from its open position to its closed position.

12. The unit as defined in claim 6 further comprising means for releasably locking the rear door alone in its closed position.

13. The unit as defined in claim 12 wherein the means for releasably locking the rear door alone includes means for binding the rear door to the housing when the rear door is in its closed position.

14. The unit of claim 6 further comprising bracket means connected to the housing for facilitating the mounting of the unit within a fence or the like.

15. The unit as defined in claim 6 wherein each of the front and rear doors are connected to the housing so as to be pivotally movable between their opened and closed positions about parallel axes.

16. The unit as defined in claim 6 further comprising means for biasing at least one of the front and rear doors from its open position to its closed position.

* * * * *